US005730064A

United States Patent [19]

Bishop

[11] Patent Number: 5,730,064

[45] Date of Patent: Mar. 24, 1998

[54] SELF-STEERING RAILWAY BOGIE

[76] Inventor: Arthur Ernest Bishop, 10 Waterloo Road, North Ryde, New South Wales, 2113, Australia

[21] Appl. No.: 500,862

[22] PCT Filed: Feb. 3, 1994

[86] PCT No.: PCT/AU94/00046

§ 371 Date: Aug. 2, 1995

§ 102(e) Date: Aug. 2, 1995

[87] PCT Pub. No.: WO94/18048

PCT Pub. Date: Aug. 18, 1994

[30] Foreign Application Priority Data

Feb. 3, 1993 [AU] Australia ..... PL7084

[51] Int. Cl.[6] ..... B61F 5/38

[52] U.S. Cl. ..... 105/168; 105/169

[58] Field of Search ..... 105/167, 168, 105/169, 180, 199.2

[56] References Cited

U.S. PATENT DOCUMENTS

| | | | |
|---|---|---|---|
| 4,058,065 | 11/1977 | Seifert | 105/180 |
| 4,324,187 | 4/1982 | Sambo | 105/199.2 |
| 4,362,109 | 12/1982 | Panagin | 105/169 |
| 4,459,919 | 7/1984 | Lemaire et al. | 105/169 |
| 5,081,934 | 1/1992 | DeRo et al. | 105/169 |

FOREIGN PATENT DOCUMENTS

| | | | |
|---|---|---|---|
| 696185 | 8/1940 | Germany | 105/180 |
| 1496190 | 12/1977 | United Kingdom . | |

*Primary Examiner*—S. Joseph Morano
*Attorney, Agent, or Firm*—Spencer & Frank

[57] ABSTRACT

A self steering railway bogie configured to run on a railway track having two opposed rails defining a track centerline therebetween. The bogie has a forward end and a rearward end and includes a pair of axle sets having a forward axle set and a rearward axle set disposed at the forward end and at the rearward end of the bogie, respectively. Each axle set has a pair of independently rotating wheels defining wheel axes, each wheel being disposed at a respective side of a corresponding axle set and further having a rail-engaging profile such that a wheel of each axle set moving away from the track centerline rises and a wheel of each axle set moving toward the track centerline falls. The axle sets are configured such that, when the bogie enters and traverses a curved section of track defining a center of curvature, the wheels of the forward axle set move away from the center of curvature and the wheels of the rearward axle set move toward the center of curvature whereby the forward axle set and the rearward axle set become inclined at different inclination angles with respect to a horizontal plane as a function of a curvature of the track. The bogie further includes a mechanism arranged and constructed for steering the bogie in response to the inclination angles of the axle sets such that the wheel axes converge on the center of curvature of the curved section of track.

16 Claims, 13 Drawing Sheets

SELF-STEERING RAILWAY BOGIE

FIELD OF THE INVENTION

This invention relates to railway bogies as widely used on railways, tramways, and the like to support a carriage or locomotive.

BACKGROUND

The principle conventionally used to guide a carriage on a railway track, introduced by Stephenson in about 1830 is to employ two wheelsets each comprising an axle having a wheel rigidly attached at each end the wheels having conical running surfaces, tapered away from the middle of the axle. This arrangement is usually termed the conicity principle.

The angle of the taper is about one in twenty, and it is common practice to incline the surface of the rail heads at a similar angle to ensure adequate load distribution over the area of contact between wheel and rail. Because the wheels are solidly mounted on the axle (and not free to rotate independently as in automotive practice), any displacement of the axle from the center line of the track causes the outboard wheel to roll on a larger diameter and the inboard wheel on a smaller diameter causing the axle to steer back to the center of the track. In a curved section of track each wheelset takes up a position displaced outwardly from the center of the track an amount appropriate to the degree of curvature, and provision must be made for the axles to steer so that their axes converge. This steer angle for a given radius increases with the spacing between the axles and becomes impractical for long carriages, which lead to the adoption of bogies having closely spaced axles at each end of carriages. The taper of the wheels must be great enough to allow the bogie to traverse the given track radius without undue sideways displacement but not great enough to precipitate cyclic yawing oscillations of the bogie which tend to increase in severity with speed. Such oscillations are inherent in the conicity principle wheelset.

In recent decades, attempts to increase greatly the speed of trains has led to the adoption of special profiles and very close tolerances in the profiles of the running surfaces of the wheels which tend to deteriorate rapidly at high speeds. Grinding techniques have been developed to regularly restore the wheel profiles and also those of the rail heads in some cases. Low cone angles reduce the tendencies of such bogies to oscillate but preclude trains equipped with such bogies negotiating curved tracks less than hundreds of meters in radius. However, when new railways are built, particularly in suburban environments, they often require tracks that include tight bends and also steep gradients.

Summarising, the shortcomings arising from the use of conventional bogies using the conicity guidance principle are as follows:

1. Marginal dynamic stability leading to bogie oscillations and hence poor comfort for passengers which problems increase with speed.
2. Poor performance in tight curves leading to rapid track and wheel wear, noise, and the risk of derailment.
3. Reduced adhesion of wheels on the rails due to the presence of a slippage zone occurring within the contact area which is inevitable using conical wheel treads.
4. Because of the presence of the above-mentioned slippage, the rolling resistance of a train is substantially greater than if, for example, cylindrical wheels-are used.
5. Restricted ability to negotiate very tight curves, which in urban areas makes new railway installations more expensive due the cost of land resumptions or tunnelling.

Many attempts have been made to overcome the problems of conicity-based wheelsets. However, these attempts have met with limited success, and designers are turning to bogies having four independent wheels for a solution. For example, UK Patent 1,496,190 by Arthur Seifert entitled "A Truck for a Railway Vehicle" discloses a pair of indepently rotating wheels for a railway bogie, the wheels secured to rotating axles which are downwardly inclined between 5° and 45°. The arrangement is intended to operate on conventional tracks having substantially flat rail heads and it follows that the wheel running faces comprise steep cones with their apexes in board of the wheel. This arrangement claims to provide less flange wear and friction and improved distribution of wheel loads to the bearings of the axles. However, such an arrangement would inevitably increase the frictional drag and wear of the main lead carrying lead contact area between the wheels and rails. No steering of the wheels is possible with Seifert's arrangement.

SUMMARY OF THE INVENTION

The object of the present invention is to overcome or minimise the disadvantages of the prior art railway bogies, such as inadequate dynamic stability, poor performance in tight curves which leads to track and wheel wear; and slippage between wheels and track which restricts the ability to climb substantial grades and results in a greater rolling resistance.

The present invention achieves the above object by providing a steerable railway bogie having independently rotatable wheels in which the bogie senses the curvature or deviation in the track upon which it runs, the bogie and track configuration being such that a relative twist occurs between front and rear axle sets and that the wheels of the bogie are steered to align themselves with their respective rails.

The steerable railway bogie of the present invention allows for tracks having a tighter curvature and steeper grades to be used which are particularly important in main line railways but also in personal rapid transit and light rail systems.

In describing the railway bogie of the present invention which employs independently rotatable wheels, each pair of opposite wheels and their associated axles will be referred to as an axle set, and a "virtual axle" will be said to exist between the pair of wheels defined by the points where the axes of the wheel axles intersect the mid-planes of the wheels. These mid-planes are defined as the planes normal to the wheel axes which include the contact points between the wheels and the rails on a straight track.

In a curve, the front axle always initially runs outwardly of the center of the track and the rear axle inwardly of the center of the track that is, towards the center of curvature of the track, and hence, because of the inclination of the wheel axles, one axle will be tilted relative to the horizontal plane in opposite direction to the other.

The essence of the invention lies in using this relative tilt to steer one or both axles in a turn to converge on the center of turn, until a steady state yaw of the bogie to the track is achieved. It follows that the longitudinal axis of the bogie at the mid-point between the axle sets will always lie at an angle to the tangent to the curve of that point.

Similarly, when the bogie is momentarily deflected due to track deviation or disturbing forces whether on a straight or curved section, a momentary tilt or change of tilt between the front and rear virtual axles will restore the bogie to its true course relative to the track. This relative tilting of the virtual axles is therefore used, according to the invention, as a true source of track direction, ignoring small, transient perturbations of track roll which cause only momentary steer inputs which are negated as the bogie traverses the length along the track equal to its wheelbase. Such selectivity can be aided by damping means on the steering of the wheels so that the bogie responds in steer principally to the intended course or heading.

The present invention comprises a self steering railway bogie to run on a railway track having two opposed rails, the bogie having a pair of axle sets one at each end, each axle set having a pair of wheels at opposite sides thereof, each wheel being independently rotatable on an axle, the wheels of at least one axle set having contours on the periphery thereof such that, on being displaced laterally with respect to the other axle set and relative to the center line of the track, one wheel will rise and the other will fall with respect to the wheels of said second axle set whereby said one axle set becomes tilted with respect to said second axle set and means responsive to said tilt to steer one or both axle sets.

Preferably each wheel has an axle whose axis is inclined downwardly toward the center of the track, and a contour on its periphery where it contacts said track also downwardly inclined toward the center of the track, wherein said means responsive to said tilt of one of said axle sets with respect to the other axle set is connected by a linkage to the axles and is constructed and arranged so as to steer each said axle set so that each wheel of the set tends to align with the center line of the respective rail beneath it.

BRIEF DESCRIPTION OF THE DRAWINGS

The nature of the invention, the consideration leading to its development and a number of embodiments according to the invention are hereinafter described by way of example with reference to the accompanying drawings, which are briefly described below.

DETAILED DESCRIPTION OF THE INVENTION

FIGS. 1 to 4 show views of a bogie as applied to mainline railways made according to a first embodiment of the invention. The bogie may be set to operate in either direction and, as shown, operates to the right, arrow 1. Wheels 2 & 3 form part of first axle assembly 4, and wheels 5 & 6 form part of second axle assembly 7.

Figure 2:
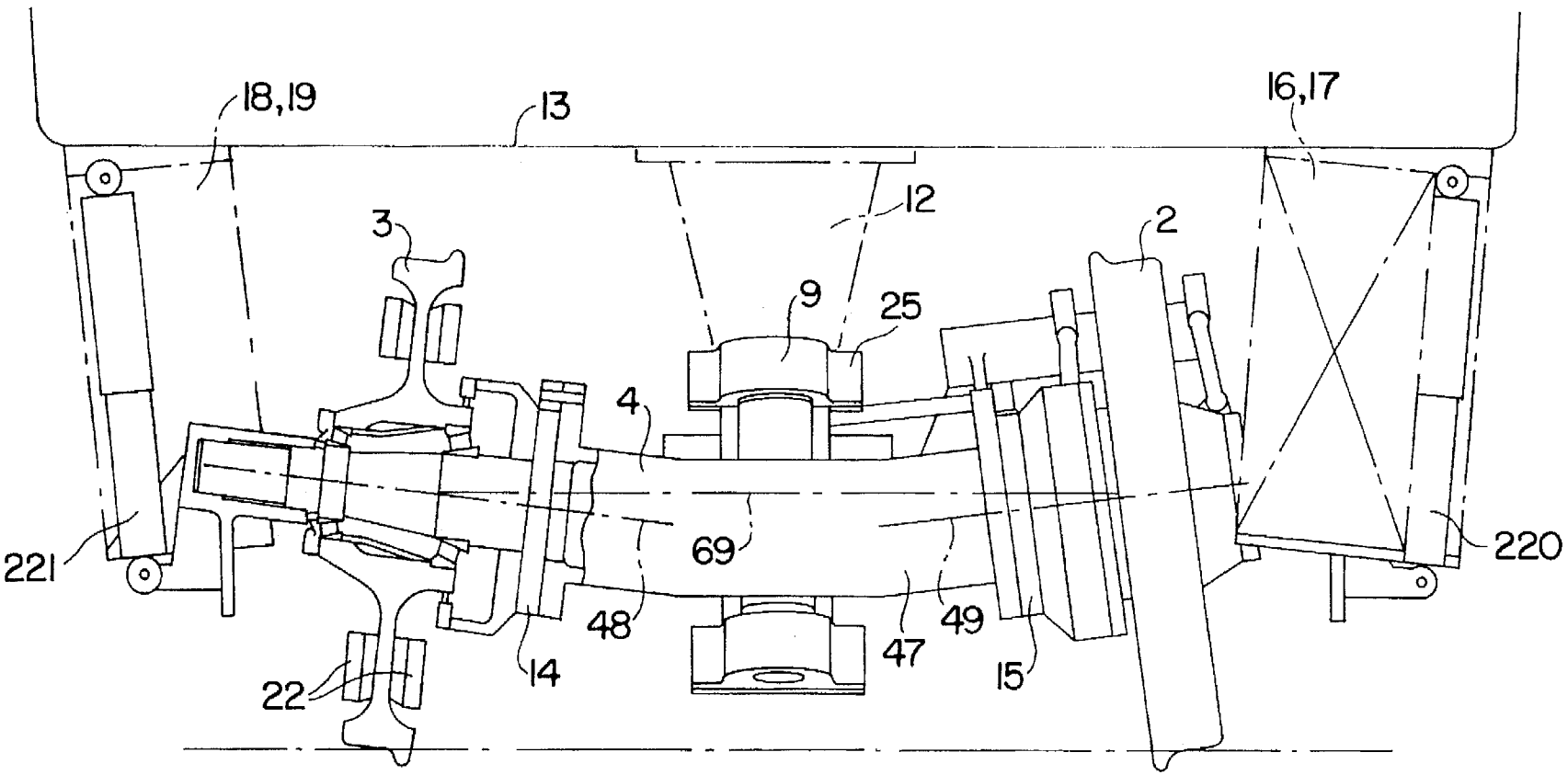
FIG. 2 is an end elevation view of the bogie of FIG. 1 with a partially sectional view along line AA.
Figure 3:
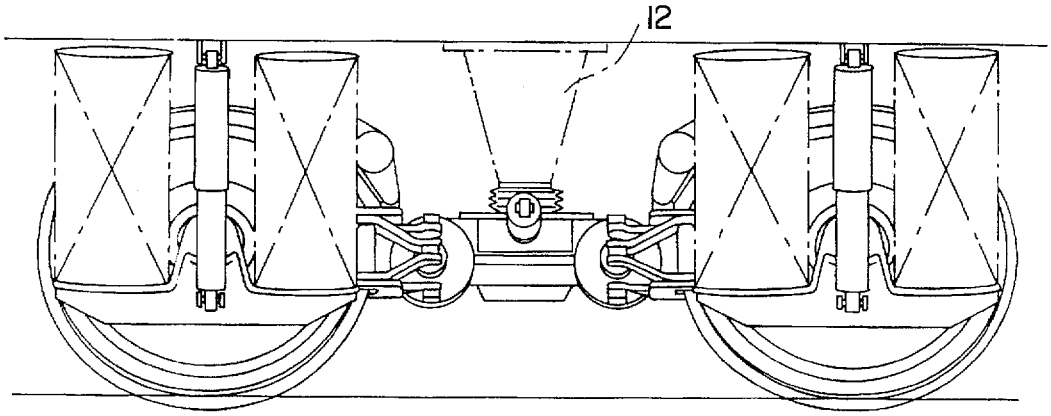
FIG. 3 is a side elevational view of the bogie in FIG. 1.

Axle assemblies 4 & 7 are pivoted at pivot points 9 & 8 with respect to longitudinal beam 10, which itself is pivoted at center point 11 to pillar 12 attached to the underside of carriage 13 (partially shown in FIG. 2). Center pivot 11 incorporates rubber damping bushes and serves to transmit lateral and longitudinal forces between the bogie and carriage 13 but is such as to allow free vertical movement there between.

During operation of the bogie in direction 1 pivot 8 on second axle assembly 7 is locked as will be described later so that axle assembly 7 and longitudinal beam 10 acts as one integral member.

Figure 1:
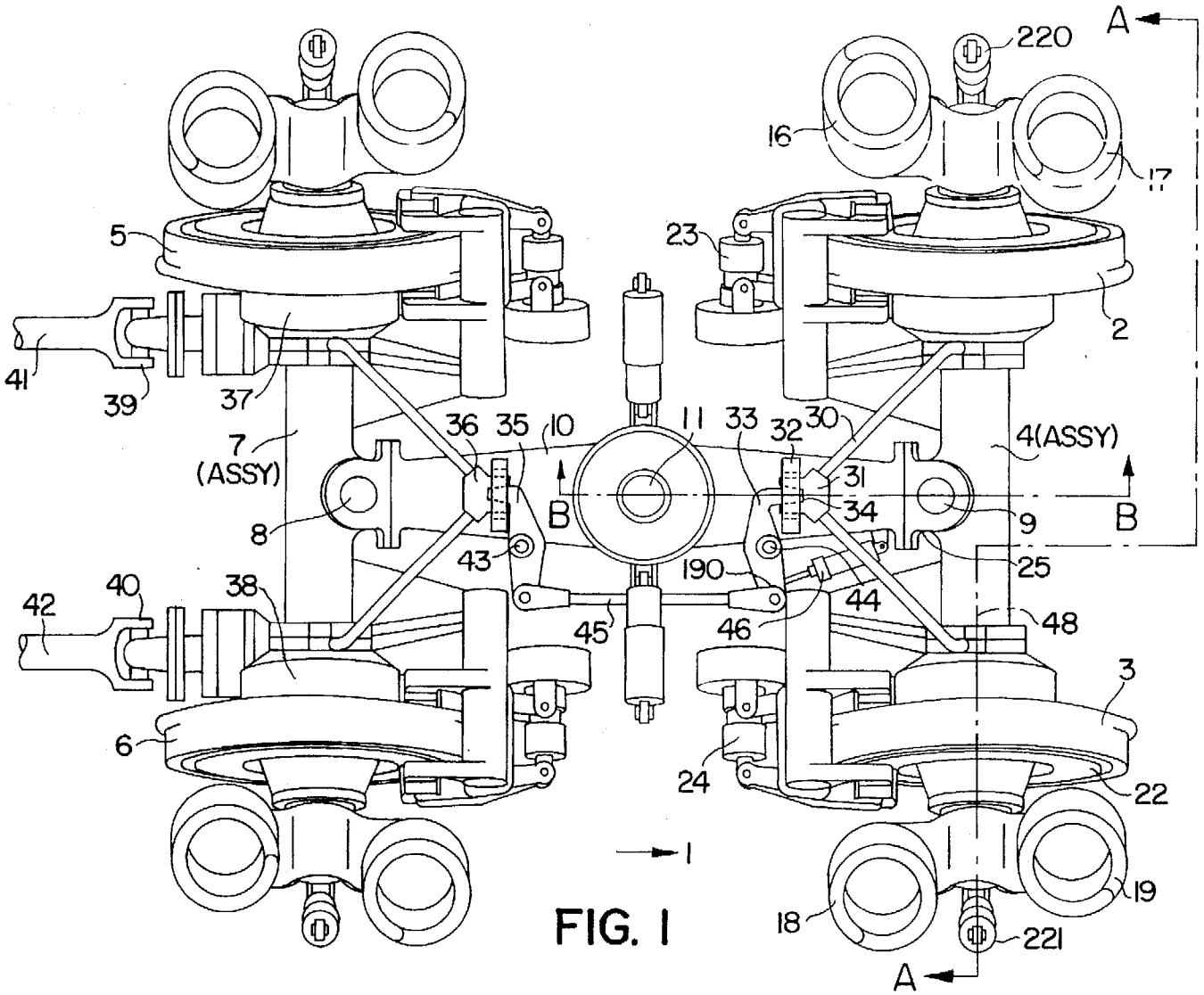
FIG. 1 is a plan view of a bogie made according to a first embodiment of the invention.

Axle assembly 4 (FIG. 2) comprise wheels 2 & 3 which are journalled on stub axles 14 & 15, which are in turn bolted to opposite ends of crossbeam 47 and extend outwardly to provide mountings for springs 16, 17, 18 & 19 and shock absorbers 220 & 221, attached to the underside of carriage 13 to allow the bogie to swivel in curves. Stub axles 14 & 15 have their axes 48 & 49 downwardly inclined towards the center of the bogie. Wheels 2 & 3 are provided with brake disks 22 (sectional view, FIG. 2) and brake assemblies 23 & 24 (FIG. 1).

A first pivot assembly 25, (FIG. 4) is located at pivot 9 and comprises brackets 26, attached to longitudinal beam 10, journals 27 and pivot pin 28, which is carried in crossbeam 47. Pivot pin 28 is shown inclined to the vertical at some small angle 29. In other not shown embodiments this angle 29 may be large. Journals 27 incorporate resilient material and are arranged to allow some axial movement on pivot pin 28 but are substantially rigid in the radial directions.

Axle assembly 4 carries brace 30 incorporating escapement member 31 which serves both to limit the maximum angular rotation of axle assembly 4 with respect to longitudinal beam 10 by abutments provided in bridge member 32, and to prevent any rotation of axle assembly 4 about pivot 9, upon operation of latch 33. As shown in FIG. 1, latch 33 is disengaged from notch 34 provided in escapement member 31 so permitting axle assembly 4 to pivot about pivot 9 through some small angle typically around 2 degrees. Latches 33 & 35 are pivoted about pins 44 & 43 carried on longitudinal beam 10 and are coupled at their outer ends by link 45. Air cylinder 46 pivoted to beam 10 is connected to latch 33 by pin 190 and acts to engage and disengage latches 33 & 35 alternatively depending upon the direction of travel of the bogie. In further not shown embodiments other means of operating these latches can be used.

All aspects of second axle assembly 7 are identical to those just described with respect to first axle assembly 4, except that latch 35, is as shown, engaged in escapement member 36 whereas latch member 33 is as shown disengaged from escapement member 31. It should be noted that if the direction of the bogie was to be reversed (i.e. in the direction opposite to arrow 1), then latch 33 would be engaged and latch 35 would be disengaged.

In the description of operation of a bogie the first axle set assembly will from now be termed the front axle assembly when operating in the direction shown in FIG. 1 and the second axle set will be the rear axle set.

Axle assembly 7 is shown provided with independent spiral bevel gear drives 37 & 38 to wheels 5 & 6 and are driven by flexible couplings 39 & 40 from drive shafts 41 & 42 connected to motors (not, shown) mounted underneath carriage 13. This method of driving independently rotating wheels is well-known in the art.

The manner in which the bogie is steered will now be described with reference to FIGS. 5, 6 & 7.

Figure 5:
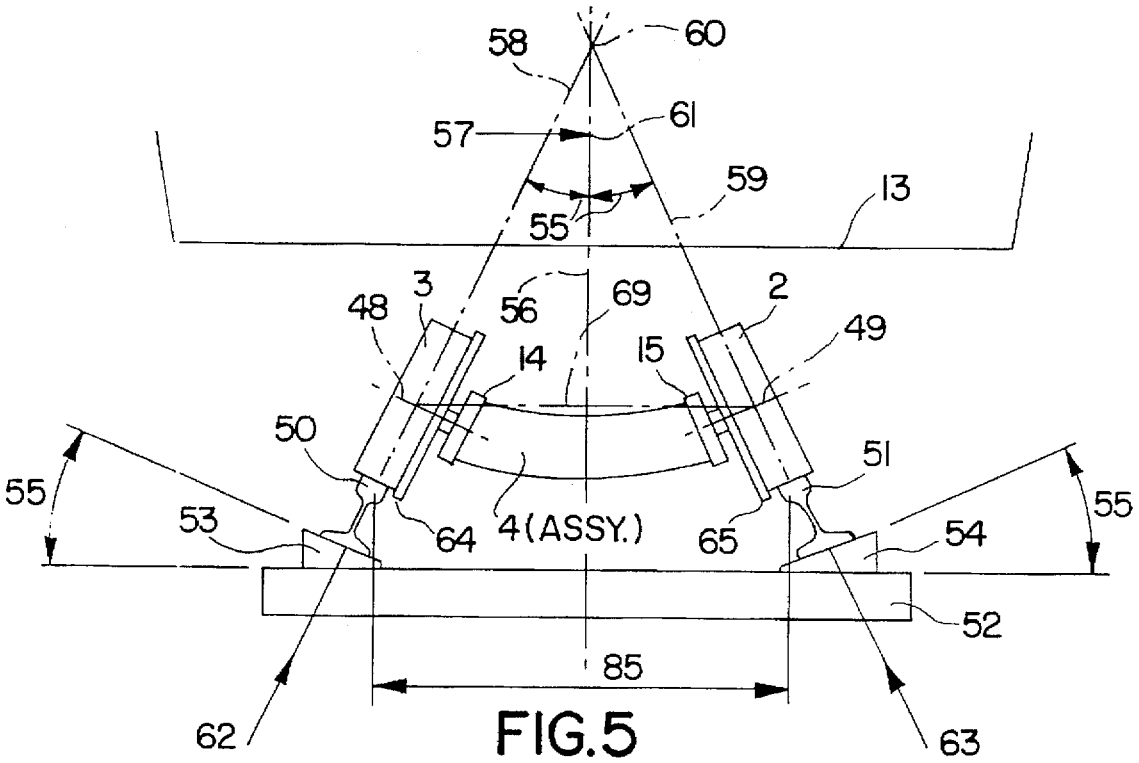
FIG. 5 is a diagrammatic front view of an axle set according to the first and second embodiment of the invention.

FIG. 5 shows the first axle assembly travelling on rails 50 & 51, which are supported on sleeper 52 by angled supports 53 & 54 at equal angles 55 to the horizontal, matching the inclination of axes 48 & 49 of stubaxles 14 & 15. Lines 58 & 59 drawn through the center of the heads of rails 50 & 51 and the mid-plane of wheels 3 & 2 at equal angles 55 to the vertical, will intersect on the centerline plane 56 of carriage 13, axle assembly 4 and rails 50 & 51 at point 60. For convenience, axle assembly 4 may be referred to as a virtual axle 69, being a line joining the intersection of stub axle axes 48 & 49 with the mid-planes of wheels 3 & 2 coincident with lines 58 and 59 respectively. The corresponding virtual axle in the case of second axle assembly 7 will be referred to as virtual axle 70.

It is evident that, if the carriage and bogies, having a longitudinal center of gravity axis 61 are subject to a horizontal force 57, acting at the center of gravity, for example, a centrifugal force in a turn, or a lateral inertial reaction force due to track deviation, and points 60 & 61 are coincident, then no rolling tendency will be imparted to the carriage and bogie. Such forces merely increase or decrease the normal forces 62 & 63 acting at the contact between wheels and rails. In a similar situation, with conventional bogies using the conicity principle, such side forces are resisted by lateral rolling frictional forces, and frequently by contact equivalent to contact here between wheel flanges 64 & 65 with the sides of rails 50 & 51. However, it is not necessary to make intersection point 60 as low as the center of gravity 61 in order to gain many of the benefits of the inclined wheel axis geometry of the invention.

A further advantage of the invention relates to the nature of the contact between the wheels and rails. When the wheels are substantially cylindrical and the railheads substantially flat the contact zones are large and essentially rectangular. There is no element of sliding contact during rolling, which inevitably occurs when a conical wheel is constrained to roll in a straight line as happens in conventional conicity-principle wheelsets, the elimination of which substantially increases the gripping force between the wheels and the rails. The angled orientation to the horizontal increases the normal force and further increases the gripping force. The elimination of the sliding component which is present at all times, substantially reduces the rolling resistance of the carriage.

Figure 5A:
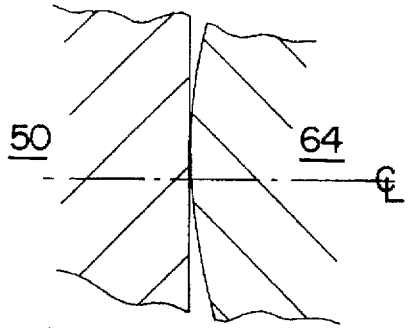
FIG. 5*a* is a partial enlarged sectional view of the area encircled in FIG. 5.
Figure 5B:
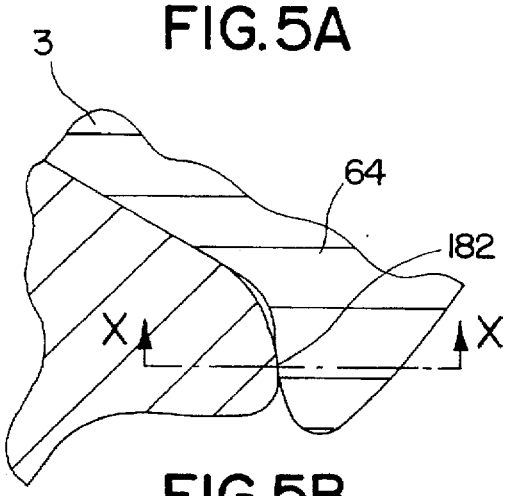
FIG. 5*b* is a cross-sectional along the line CC of FIG. 5*a*.

Furthermore, in the event of flange contact occurring, there is less tendency to lift the wheel and hence de-rail the bogies than occurs with the standard rail and wheel geometry. As shown in FIGS. 5*a* & 5*b* in partial cross-section, the face 182 of flange 64 of wheel 3 is nearly vertical in the contact zone and, being conical, contact will occur in the plane XX which lies directly below the stub axle axis 48 avoiding the shearing element of flange contact present in standard rail geometry. Instead, if flange contact occurs, the tangential component of the contact force acts at a larger radius than the rolling radius of the wheel. This factor is important in overcoming what might be seen as a disadvantage of the pivoted beam front axle, namely, the tendency for the axle to be deflected to the limits (e.g. 2 degrees) by, say, an obstruction on the rail. The flange contact thus provides the necessary restoring force, in this event, to realign the axle with the direction of the track. This restoring force, which is present but to a lesser degree in conventional wheel sets is far less effective under the same circumstances because of the rigid connections between the wheels, whereas the restoring force is highly effective in the case of independent wheels according to the invention.

Figure 6:
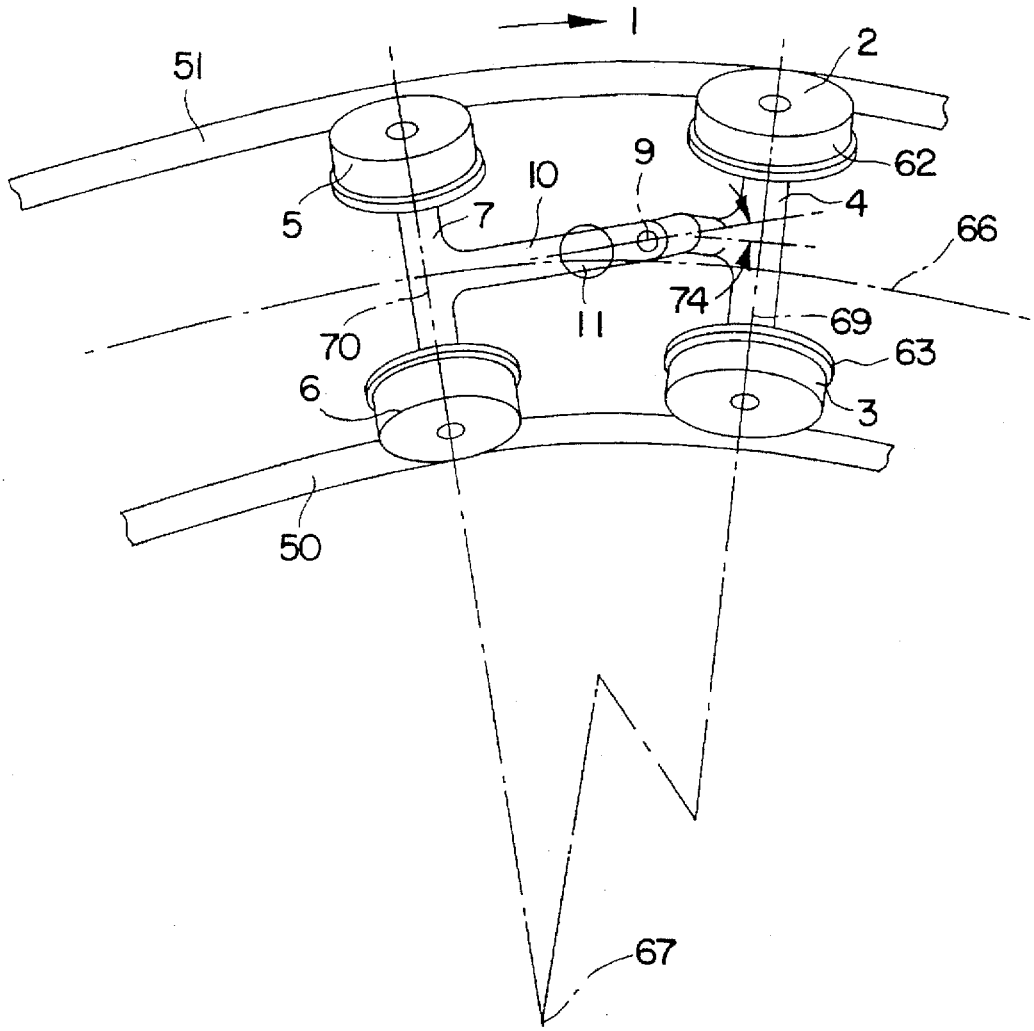
FIG. 6 is a diagrammatic plan view of the first embodiment of the invention in a turn.

FIG. 6 shows a plan view of the bogie when traversing a curved section of track having centerline 66, and center of turn 67. As mentioned earlier, when a bogie is travelling in the direction 1, the rear axle assembly 7 is maintained by latch 35 (FIG. 1) in a central position with respect to longitudinal beam 10 and hence is here shown as a single member, whereas front axle assembly 4 is free to swivel under the action of steering forces produced by inclined pivot 9.

On entering such a turn, front wheels 2 & 3 will tend to continue in a straight line and hence axle assembly 4 will move outwardly and rear axle assembly 7 will move inwardly of track centerline 66, until the stable orientation of the bogie shown in FIG. 6 is reached. The spacing of rails 50 & 51 is slightly increased in curves if necessary to allow for the angled orientation of the bogie.

Figure 7:
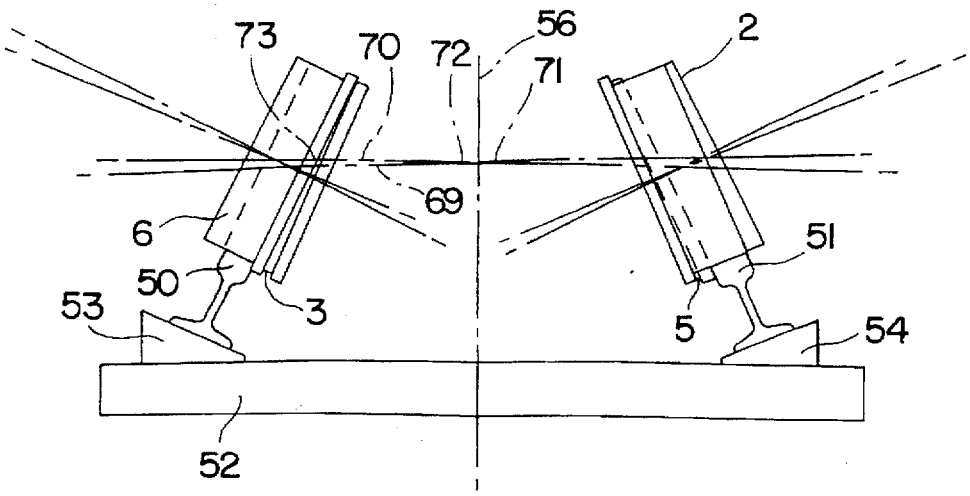
FIG. 7 is a diagrammatic view of superimposed elevations of the front and rear axle sets of FIG. 6.

In FIG. 7 front wheels 2 & 3 are shown relative to rear wheels 5 & 6 as viewed along their respective sections of track shown in FIG. 6, the views being superimposed with respect to centerline 56.

The mid-points of virtual axles 69 & 70 are shown as 71 & 72 and lie respectively outside and inside of track centreline 56.

Having entered the turn an angle of twist 73 will occur between the front and rear axle assemblies of the bogie which must be accommodated by rotation of the front axle assembly 4 with respect to rear axle assembly 7 through an angle 74 (FIG. 6).

The necessary inclination angle 29 to the vertical, of pivot 9 (FIG. 4) is calculated as described later in the specification and is such that twist angle 73 produces rotation 74, termed the steer angle, and that the axes of virtual axles 69 & 70 converge, in plan view, on center of turn 67.

The first embodiment of the invention is also suitable, for example, to the bogies of small, automated vehicles, such as in light rail systems, where it is important that very sharp curves can be negotiated and, at the same time, that the noise associated with flange contact of steel wheels on steel rails in curves be avoided.

Generally such small vehicles only require to be operated in one direction. Since the vehicles are light, each bogie need only have one pair of load-carrying wheels, such as the front axle assembly. Each vehicle may further incorporate a differential which is driven through universal joints from an electric motor mounted on the underside of the carriage. The brake is also mounted on a motor, so that any slewing action originating in a difference in the driving or braking torque applied to opposing wheels is avoided.

The front axle assembly is pivoted directly to the underside of the carriage through a vertically sprung pivot. A frame pivoted on an inclined axis to the front axle assembly carries two small inclined wheels also engaging the track which provide the steering signal to the front wheels in a manner similar to that described in the first embodiment.

In a second embodiment of the invention, illustrated in FIGS. 8 to 14, a different mechanism is used, notwithstanding that the system operates in substantially the same manner as that described in embodiment 1 and is principally suitable for mainline railways.

Figure 8:
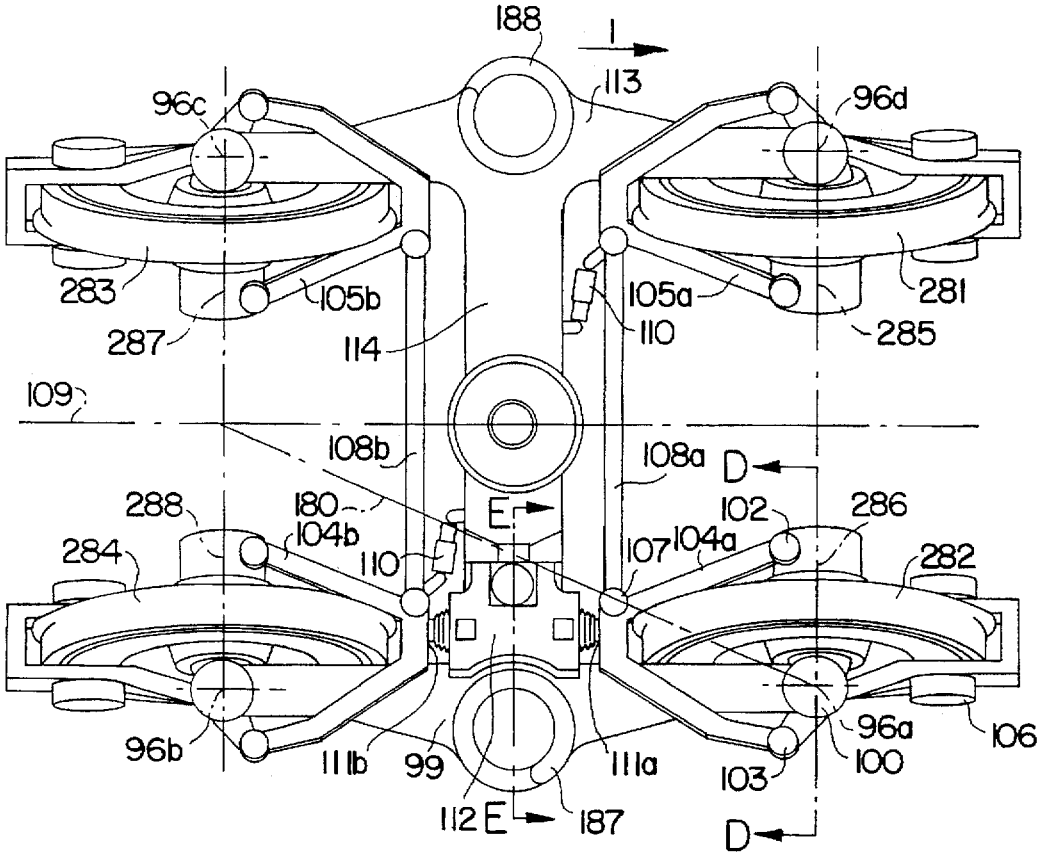
FIG. 8 is a plan view of the second embodiment of the invention.
Figure 10:
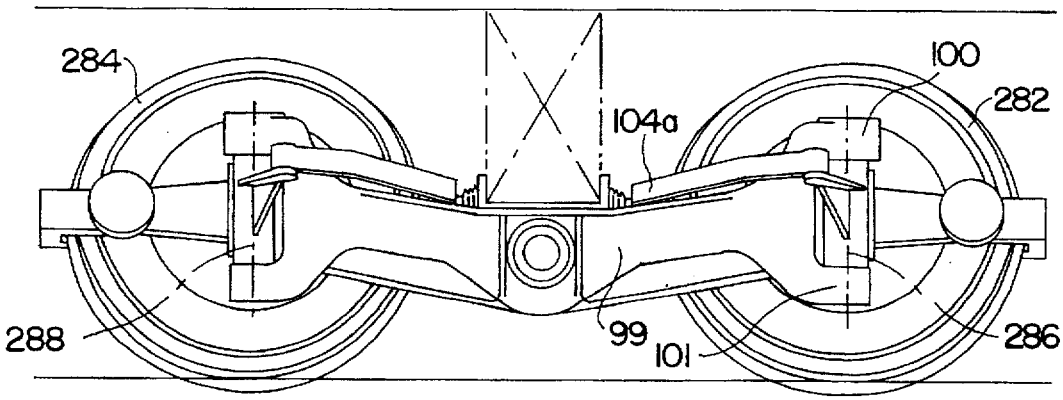
FIG. 10 is a side elevational view of the bogie shown in FIG. 8.

This second embodiment provides for a lower unsprung mass than in the case of the earlier embodiment and although the mechanism is more complicated it is probably better adapted to use in high speed trains. In this embodiment all four wheels are steered independently rather than by virtue of being mounted as pairs on front and rear axle beams. As in the case of the first embodiment, the bogie may be operated in either direction and, as shown in FIG. 8, operates to the right, in the direction of Arrow 1. Wheels 281, 282, 283 & 284 are all journalled on stubaxles as shown in section with respect to wheel 282 in FIG. 9 and have corresponding axes of their respective stubaxles and wheel journals numbered 285, 286, 287 & 288 respectively. All wheels and axles are identical (except for right and left handedness) and the following description in relation to wheel 282 and its associated stubaxle 89 (FIG. 9) is typical of all four wheels.

Figure 9:
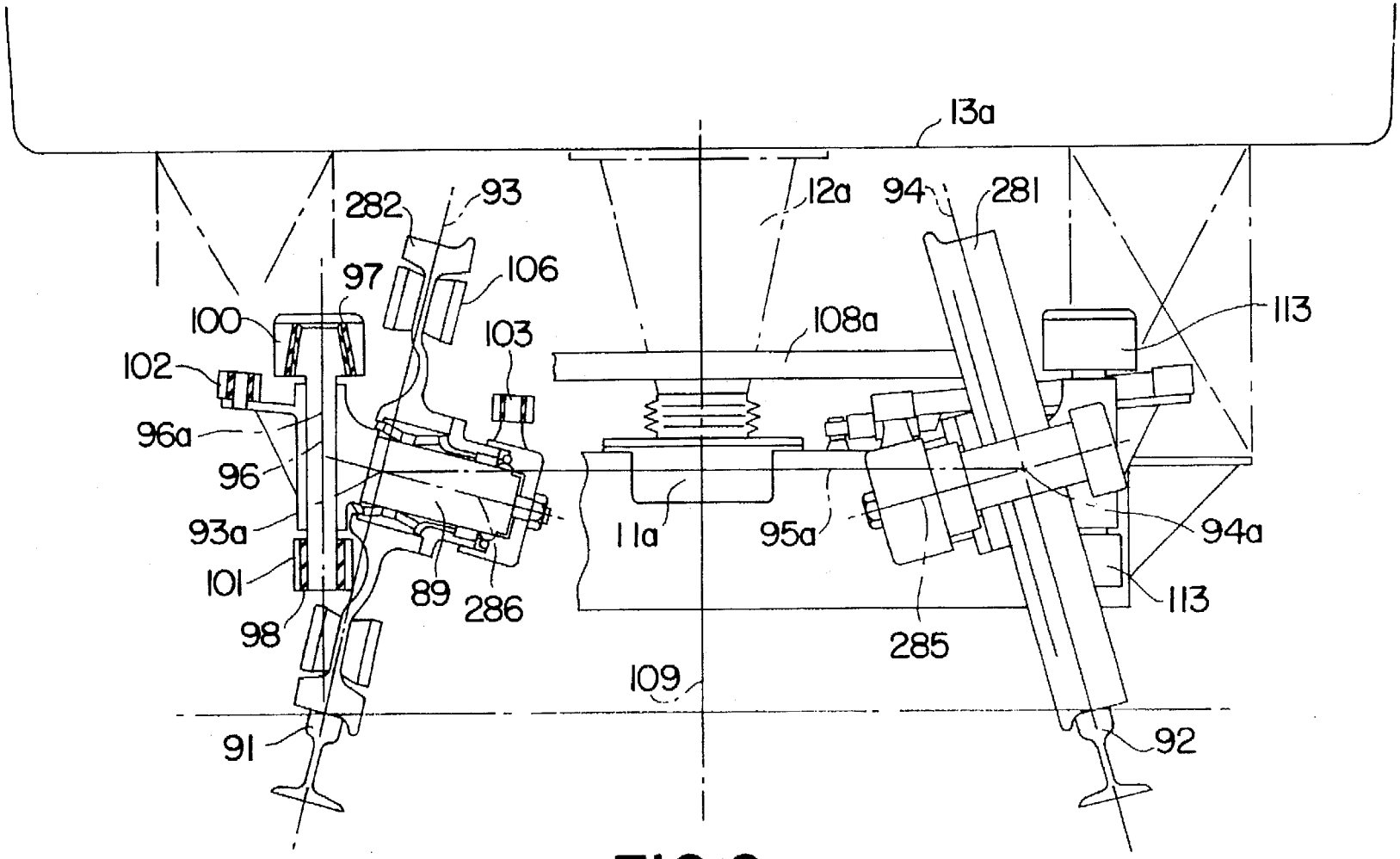
FIG. 9 is a cross-sectional view of the bogie part along line DD of FIG. 8.

Considering the front axle arrangement as shown in FIG. 9 it will be seen that the axes 285 & 286 correspond to the axes 49 & 48 of FIGS. 2 & 5.

The planes 93 & 94 of wheels 282 and 281 passing through the centerline of rails 91 & 92 in the straight ahead running position as shown in FIG. 9, correspond to lines 58 & 59 in FIG. 5, and intersect the respective axes 286 and 285 at points 93*a* & 94*a*. Line 95*a*, joining these points, becomes the "virtual axle" corresponding to the virtual axle 69 of FIG. 5.

Front stubaxle 89 extends outwardly to house vertical pivot pin 96, an arrangement as that used for steering some automobiles commonly termed as king pin steering.

Preferably the axes of pin 96 extends downwardly to intersect the head of rail 91 at the center of its area of contact with wheel 282.

As a result of the above arrangement, the geometry of the bogie, as is well-known in automotive practice, reduces to an absolute minimum the forces required to steer the wheels, or the forces which can be transmitted by way of obstructions to the wheels.

Pivot pin 96 is journalled in resilient bushes 97 & 98 to side frame member 99 (FIGS. 8 and 10) which is extended as at 100 & 101 to provide housings for bushes 97 & 98. Pivot pin 96 has an enlarged tapered head to transmit vertical force as well as lateral forces through resilient bush 97 to side frame extension 100.

Stub axle 89 is provided with attachment mountings for a caliper disc brake 106 similar to that shown in FIG. 1, except that the caliper pivots with stub axle 89 rather than axle assembly 4 (FIG. 1).

As shown in FIG. 8, stub axle 89 also provides inner and outer attachments 102 & 103 for steering arm 104*a* which serves to steer wheel 282 about the axis 96*a* of pivot pin 96. Steering arm 104*a* carries a tie rod ball joint 107 which provides a connection for tie rod 108*a* similarly attached to steering arm 105*a* associated with wheel 281. It will be seen that a line 180 passing through axis 96*a* of pivot pin 96 and the axis of ball joint 107 intersects the centreline 109 of the bogie at a line joining the axes 96*b* and 96*c* of the pivot pins associated with wheels 284 & 283 respectively, all of which are similar to the widely-used automotive steering geometry referred to as the Ackermann geometry. This arrangement assures that, in curves, the axes of all wheels will intersect at the same point just as occurs with the beam axle steering arrangement as in FIG. 1 with respect to point, or center of turn 67 (FIG. 6).

Shock absorbers 110 may be provided to damp unwanted pivotal movements of wheels 281.282, 283 & 284.

As further shown in FIG. 8, steering arm 104*a* has an extension member 111*a* which enters steering transfer box 112. Corresponding steering arm 104*b* associated with wheel 284 has a corresponding extension member 111*b*. All four wheels are therefore controlled through tie rods 108*a* & 108*b* and their extension arms 111*a* & 111*b* by steering transfer box 112 in a manner to be described.

By comparing FIG. 2, the front elevation of the first embodiment of the invention with FIG. 9, a corresponding view of the second embodiment, it is evident that stub axles axes 48 & 49 correspond exactly to stub axle, 285 & 286, wheels 2 & 3 correspond to wheels 281 & 282 and virtual axle 69 corresponds to virtual axle 95*a*.

Hence in a given curve, the relative angular inclination 73 of the front and rear virtual axles will be identical in the case of the second embodiment, given that the wheelbase track and other features of the two bogies are identical.

Now in the first embodiment, this relative angular inclination is used to steer the front axle assembly 4 by virtue of the inclination of pivot 9.

Figure 11:
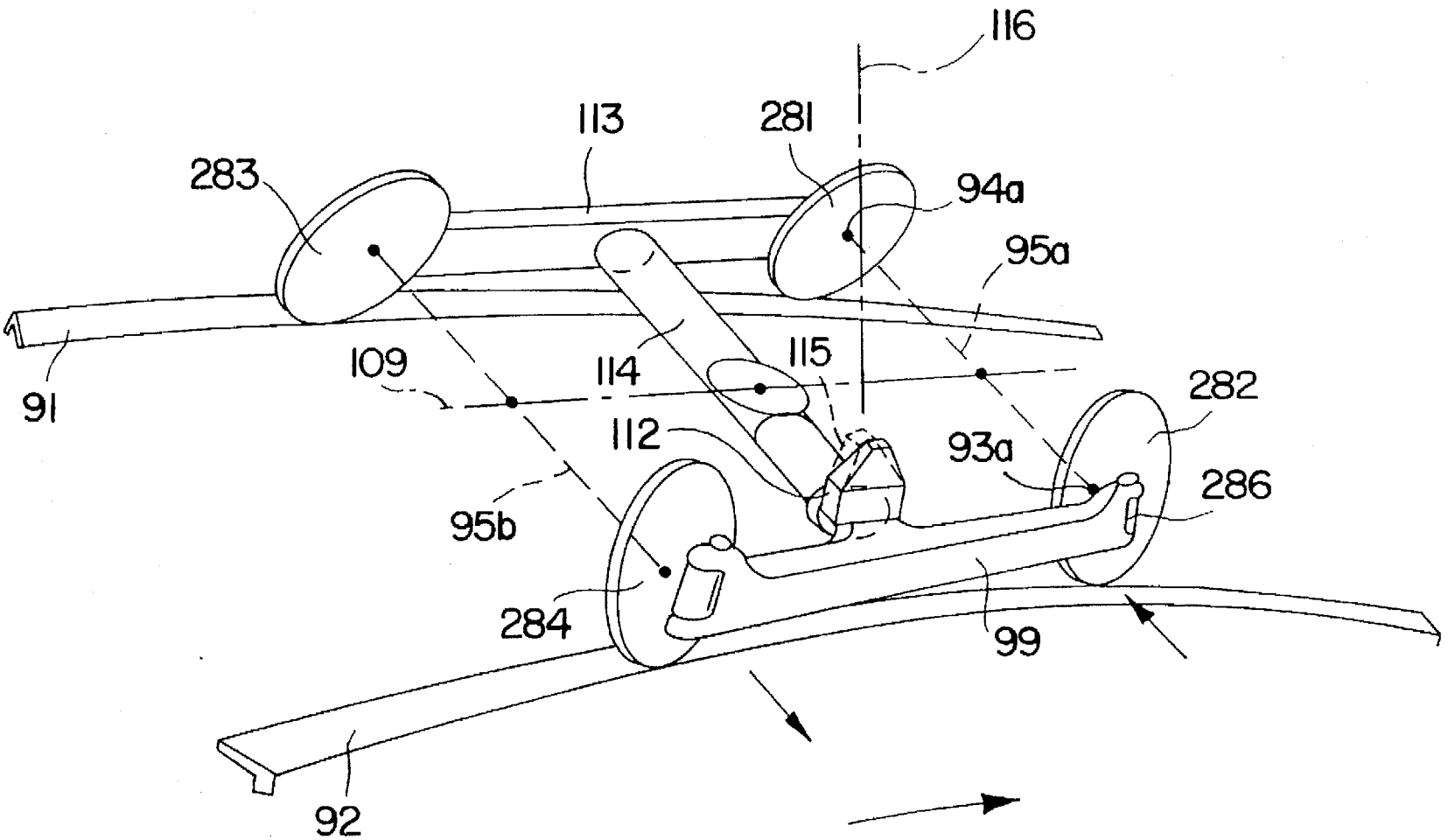
FIG. 11 is a schematic view of a bogie made according to the second embodiment of the invention.

The manner in which the same relative inclination of the virtual axles is used to steer the bogie in the second embodiment is shown in FIG. 11, where it is apparent that virtual axis 95*a* rotates counterclockwise when being viewed from the front of the bogie about longitudinal axis 109 whereas virtual axis 95*b* rotates clockwise, this being the result of the rise of wheels 281 & 284 and the fall of wheels 282 & 283 on the sloping heads of rails 91 & 92 due to the slewing of the bogie, as described with respect to the first embodiment. Thus side frame member 99 will be rotated clockwise with respect to side frame member 113 when being viewed from the right.

Figure 12:
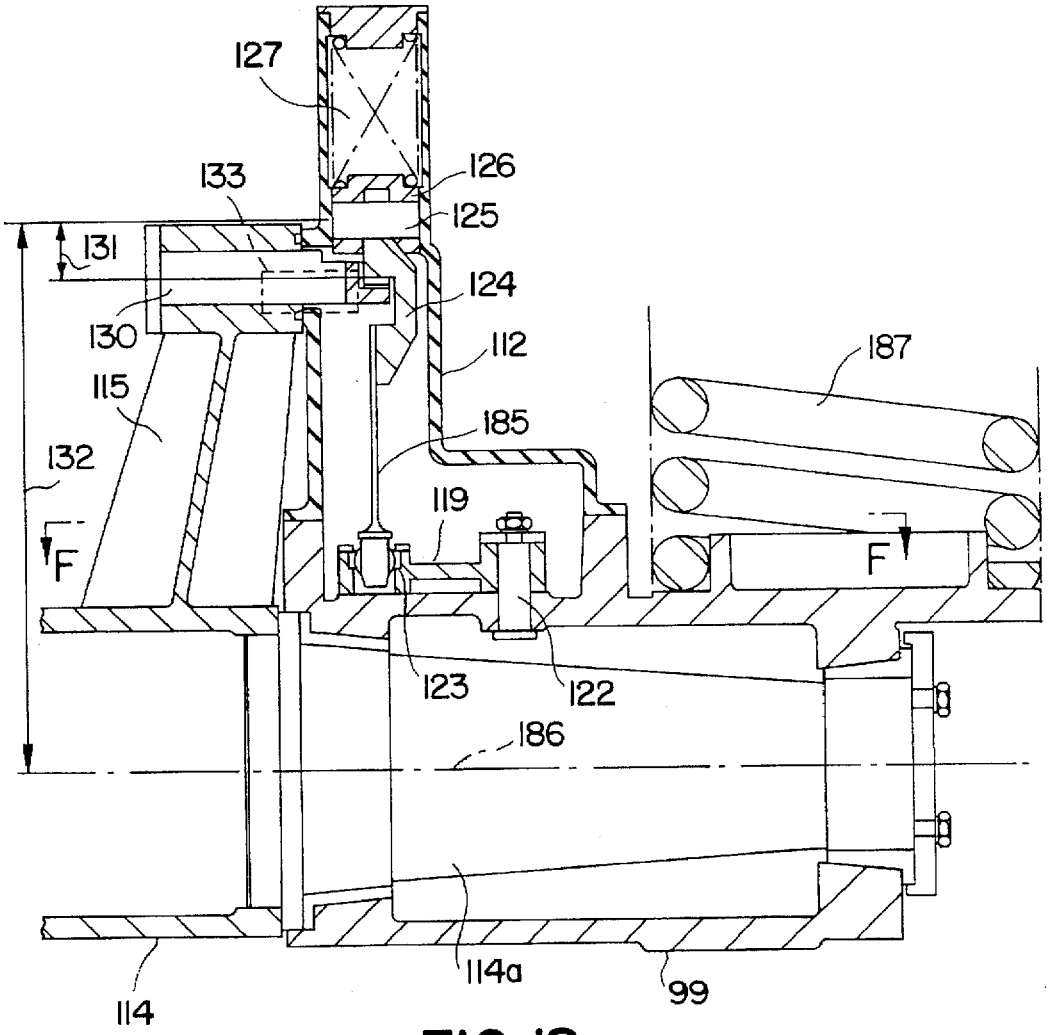
FIG. 12 is a cross-sectional view of the steering transfer box along line EE of FIG. 8.

Side frame member 113 is formed integrally with cross frame member 114 which extends laterally across the bogie and has the bolted extension 114*a* which extends through side frame member 99 and is journalled thereto as shown in FIG. 12.

Steering transfer box 112 is secured to side frame member 99 and pillar 115 is integrated with cross frame member 114, so that relative rotation will occur therebetween, as shown as angle 116. Angle 116 will have a magnitude equal to the relative angular rotation of virtual axes 95*a* & 95*b* (which is the same as angle 73 of the first embodiment as shown in FIG. 7) multiplied by the track width divided by the wheelbase of the bogie.

Figure 4:
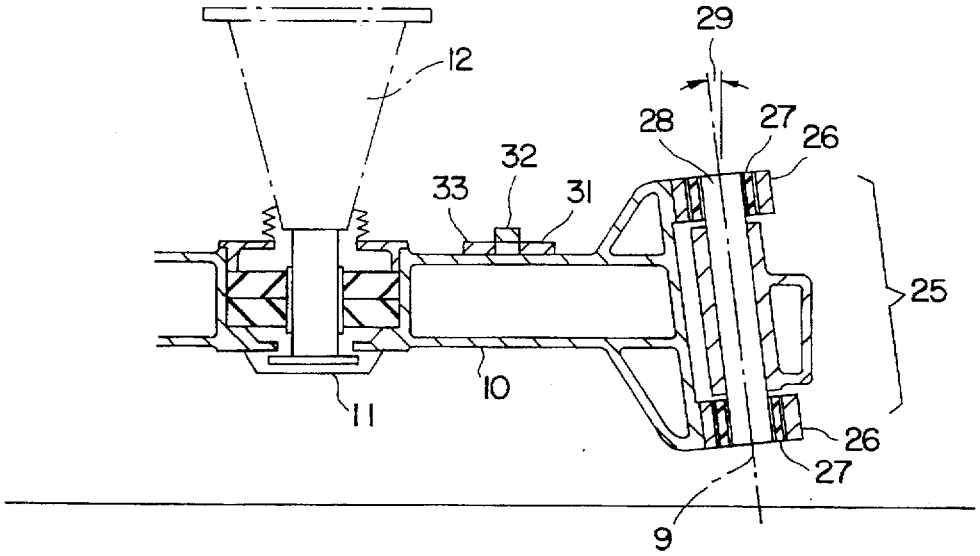
FIG. 4 is a cross-sectional elevational view along line BB of FIG. 1.
Figure 13:
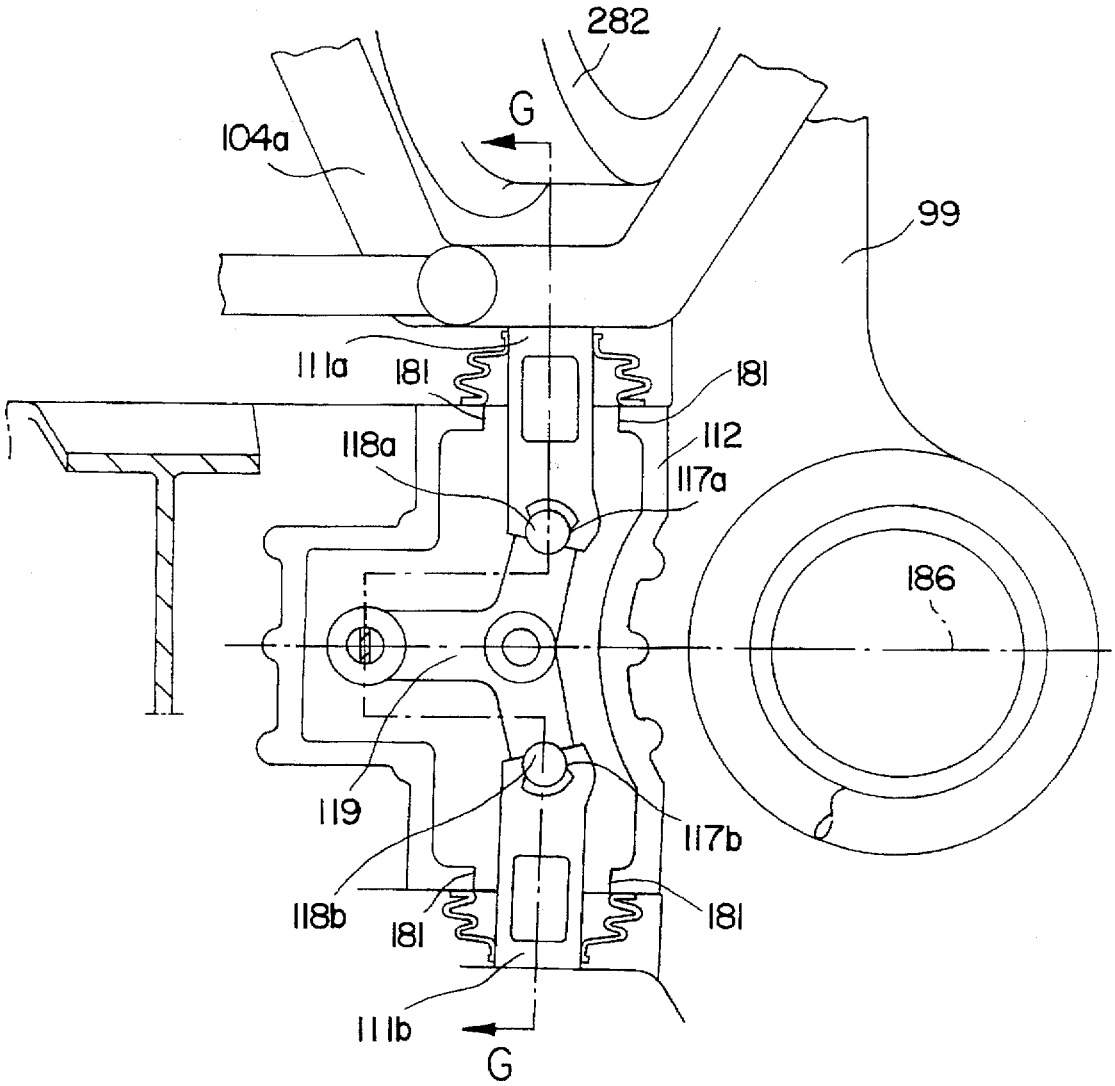
FIG. 13 is a cross-sectional view along line FF of FIG. 12.
Figure 14:
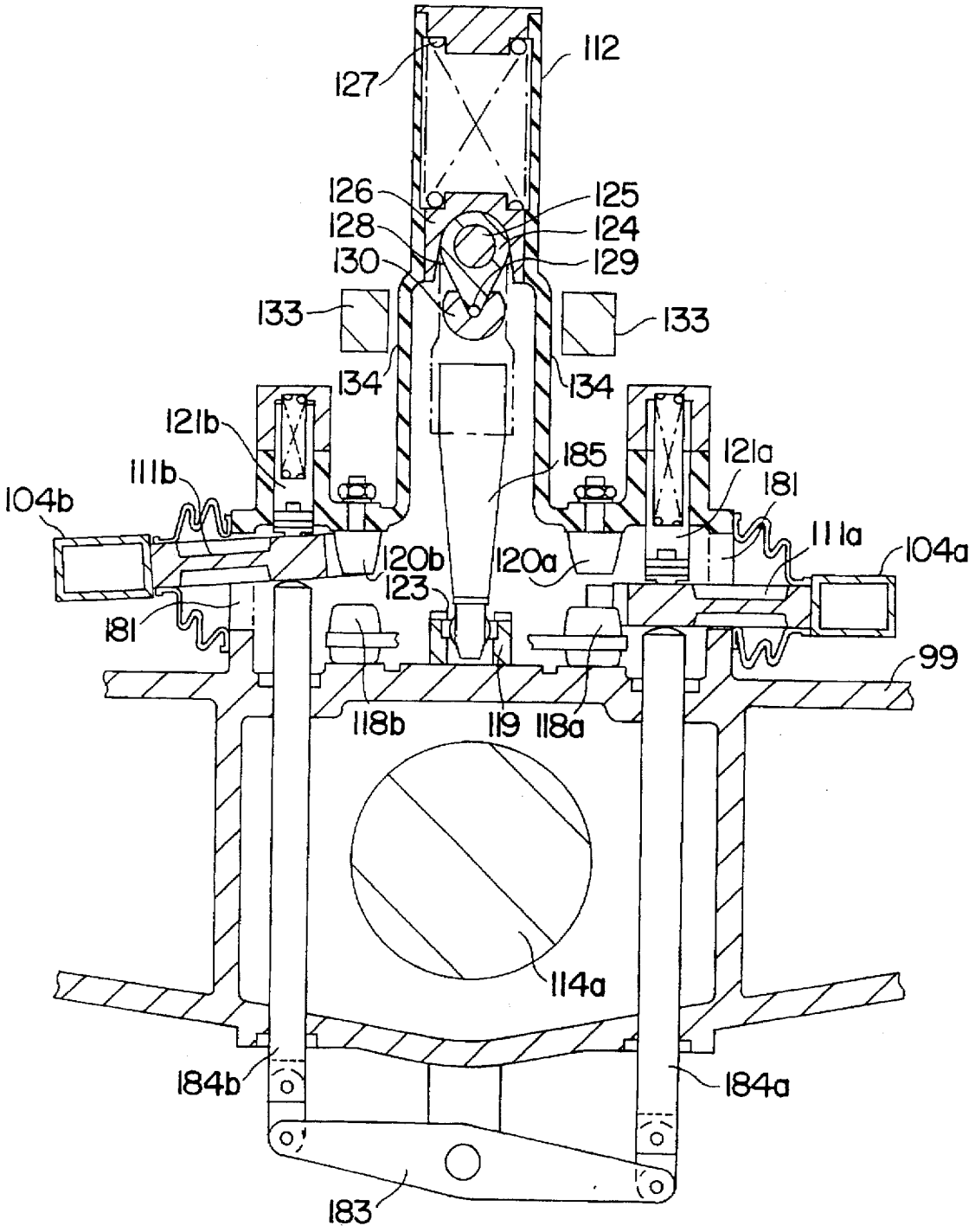
FIG. 14 is a cross-sectional view along line GG of FIG. 13.

Cross member 114 incorporates pivot 11*a* which is the counterpart of pivot 11 shown in FIGS. 1 & 4 of the first embodiment and serves to transfer lateral and longitudinal forces from the bogie to the pillar 12*a* secured to the underside of carriage 13*a* (FIG. 9). FIGS. 12, 13 & 14 show views of the steering transfer box, whose function is to respond to the relative rotation of side frame members 99 & 113 as indicated by the angle 116 (FIG. 11) and steer front wheels 281 & 282, through the appropriate angles to converge on the center of turn of the track. Referring to FIG. 14, extension members 111*a* & 111*b* extend into steering transfer box 112 through sealed openings therein, the openings being provided with abutments 181 (four places) which limit the travel of the steering arms to about 1 ½ degrees each way even under extreme load conditions.

As seen in FIG. 13, the steering extension members 111*a* and 111*b* are provided with open ended slots 117*a* & 117*b* which have slightly tapered faces top and bottom so as to engage in a slack-free manner slightly conical integral pins 118*a* & 118*b* of bell crank lever 119 and also, in alternate position pins 120*a* & 120*b* (FIG. 14), also slightly conical, fixed in steering transfer block 112.

As illustrated in FIG. 14 the bogie is moving to the right so that front steering arm 104*a* is operable whereas steering arm 104*b* is locked as in the case of the beam axle arrangement of the first embodiment.

The required raising and lowering of extension members 111*a* and 111*b* is accomplished by a rocking lever 183 which operates riser pins 184*a* and 184*b* to lift the respective extension members in opposition to spring loaded plungers 121*a* & 121*b* and is operated by an air cylinder (not shown).

Bell crank 119 is pivoted on pin 122 (FIG. 12) and extends to house spherical ball joint 123 in which slides the cylindrical lower end of lever extension 185 secured to overload release lever 124 journalled on pin 125 in crosshead 126.

Crosshead 126 is fitted closely in the bone of the cylindrical vertical extension of steering transfer box 112 and is forced downwardly by a helical spring 127, so forcing overload relief lever 124 and its detent tooth 128 into forceful engagement with a detent notch 129 provided in the extended end of pin 130 secured to pillar 115.

Now, as seen in FIG. 12, distance 131 between pins 125 & 130 is chosen, in relation to distance 132 between pin 125 and the axis 186 of crossmember 114 so that the slight difference in angle of rotation of the side members 99 & 113, shown as angle 116 in FIG. 11, is amplified, typically by a factor of ten to obtain the angular rotation of lever 185. The object of this arrangement is to amplify the slight difference of angle 116 which in general will not exceed plus or minus one degree without significant loss and to this end all journals are fitted in a slack-free manner.

Such close fitting would deteriorate if the mechanism was subject to high loads originating either in the swivelling of the wheels on the track or high loads originating in side forces applied to the side frame member.

In the case of high loads originating in the steering arms, such loads are isolated by abutments 181 (FIGS. 13 and 14). In respect of excess loads originating in the rotation of side frame members such loads are isolated by abutments 133 (FIG. 14) provided on pillar 115 contacting abutments 134 on steering transfer box 112.

The forces required to steer the wheels are only a small fraction of the forces which may arise as described. Here wear on the mechanism of steering transfer box is not excessive. Provision is made to lubricate the mechanism and exclude the entry of dirt. Springs 187 & 188 are provided with seats on their respective side frame members 99 & 113 (FIG. 12).

Whilst the first embodiment of is shown with drive to some wheels and the second embodiment is shown with no such drive, both embodiments can be with or without drive to any wheel.

Whilst in the first and second embodiments the tilt between the front and rear axle sets is conveyed and employed by mechanical means to steer the wheels, it should be understood that in other not shown embodiments other means such as electrical, electro-mechanical, hydraulic or pneumatic means may be used.

In order to apply the invention to the design of a bogie it is necessary to calculate various parameters of the construction. As an aid to this a guide to the making of the necessary calculations is given below with reference to the diagramatic FIGS. 15–21.

Figure 15:
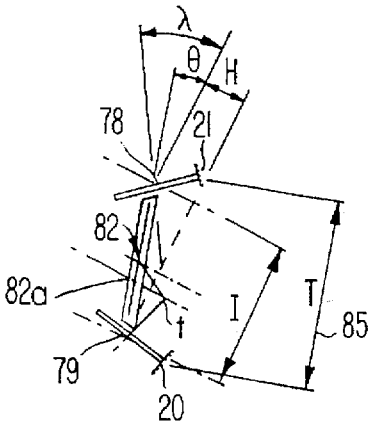
FIG. 15 is a diagrammatic view of a pivotal axle set along the direction of a curve (curve tangent view).
Figure 16:
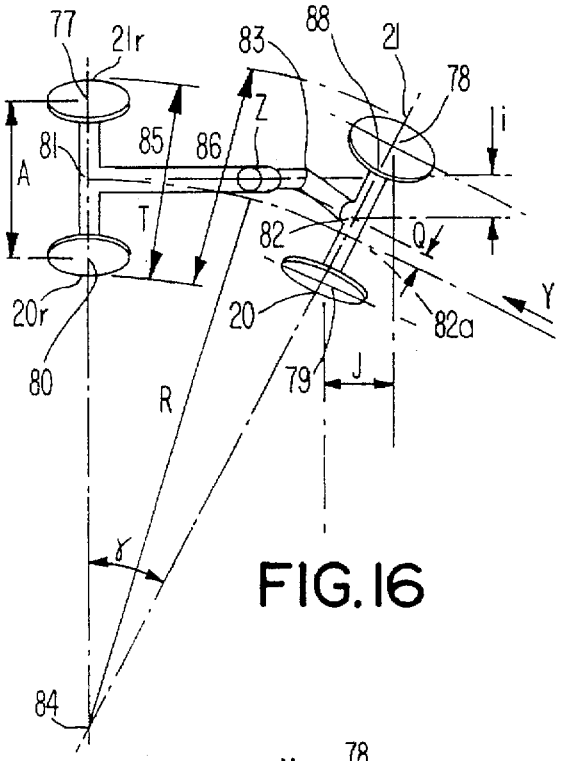
FIG. 16 is a diagrammatic top plan view of a boggie according to the invention.

FIG. 16 is a plan view of a bogie while it is rounding a curve of mean radius R. The wheels are represented as narrow discs which are located at the midpoint axially of the wheel and rim and have centers at points 77, 78, 79, 80. These discs contact the rail heads at a distance or track shown as distance 85 (also denoted as T) when running on a straight section of rail and at a larger distance 86 when negotiating a curved section of rail. This is because of the angled disposition of the bogie illustrated in FIG. 16. In practice, the distance between the center of the rail heads may be determined from FIGS. 15 to 21 and the following equations and will vary between a minimum value 85 at straight sections of track and a maximum value 86 determined by minimum track radius.

Lines joining 77 and 80 and 78 and 79 are designated "virtual axles" and points 81 and 82 are at the axle midpoints. The front and rear axles in this view converge on the center of the curve point 84 at an included angle $\gamma$.

It is well known that steel wheels when rolled on a rail have an instantaneous direction of rolling precicely in the plane of the wheel. Hence, 77, 80, 84 and 78, 79, 84 in FIG. 16 are straight lines. For the purposes of this calculation, the rear axle is assumed to be horizontal and the front axle inclined at an angle $\theta$ to the horizontal. In practice, the rear axle will be inclined in the opposite sense to the front axle, but the total relative angle of inclination $\theta$ will be the same. The angle $\theta$ is shown greatly exaggerated.

FIG. 15 is a view in the direction of arrow Y normal to the line 78, 84 in FIG. 16. In this figure the virtual axle 78, 79 is seen to be inclined to the horizontal angle $\theta$ and line 78, 79 is the true length A of the front virtual axle. The front wheels and the topsurfaces of the inclined rail heads are shown in FIG. 15. The rail surfaces are inclined at an angle $\lambda$ to the horizontal. As shown in more detail on FIG. 21 the chain dotted lines from point t to point 78 and extended, and point t to point 79 and extended represent the loci of the wheel centers as $\theta$ varies. The displacement of point 82 from the center of the track is designated Q. Even for large steer angles the vertical position of 82 is essentially unchanged. H and I are the projected lengths of the axle in the vertical and horizontal planes.

Figure 17:
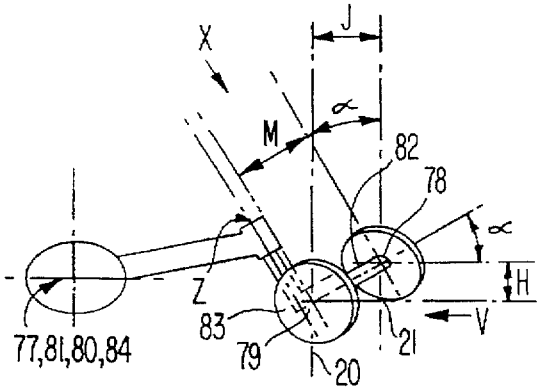
FIG. 17 is a diagrammatic side elevation view of a boggie according to the invention.

FIG. 17 is the side elevation of the bogie shown in FIG. 16. The rear virtual axle 77, 80 and the front virtual axle 78, 79 are extended towards each other at their mid-points and are hinged at Z, the axis of Z being inclined at an angle $\alpha$ to the vertical.

Figure 18:
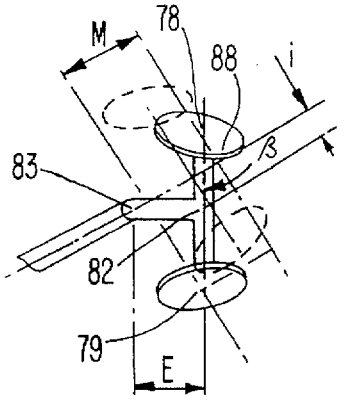
FIG. 18 is a diagrammatic view of a pivotal axle set along its pivot line (pivot according to the invention).

FIG. 18 is a view on FIG. 17 in direction x. In this view the dimension E represents the true length of the leading arm 82, 83 and 78, 79 represents the true length A (as shown in FIG. 16) of the virtual axle.

Figure 19:
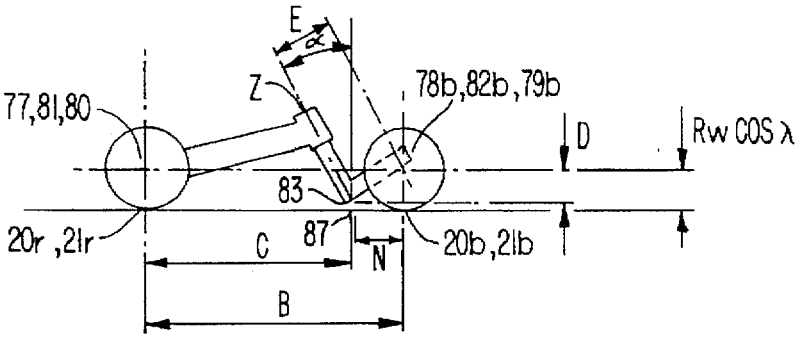
FIG. 19 is a diagrammatic side elevational view of a bogie in the straight-ahead position according to the invention.

FIG. 19 is a side elevational view of the bogie when steering straight ahead. Dimensions C and D define the position of the pivot and $\alpha$ its angle of inclination. Dimension N defines the intersection of the pivot line with the rail level at point 87.

Figure 20:
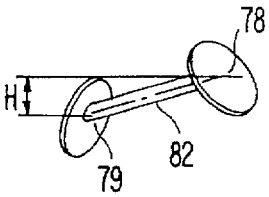
FIG. 20 is a diagrammatic view of a pivotal axle set along the direction V (front view).

FIG. 20 is a view on FIG. 17 in direction V. Dimension H defining vertical shift between the ends of the front "virtual axle" (points 78, 79) is common to FIG. 17 and FIG. 20.

Figure 21:
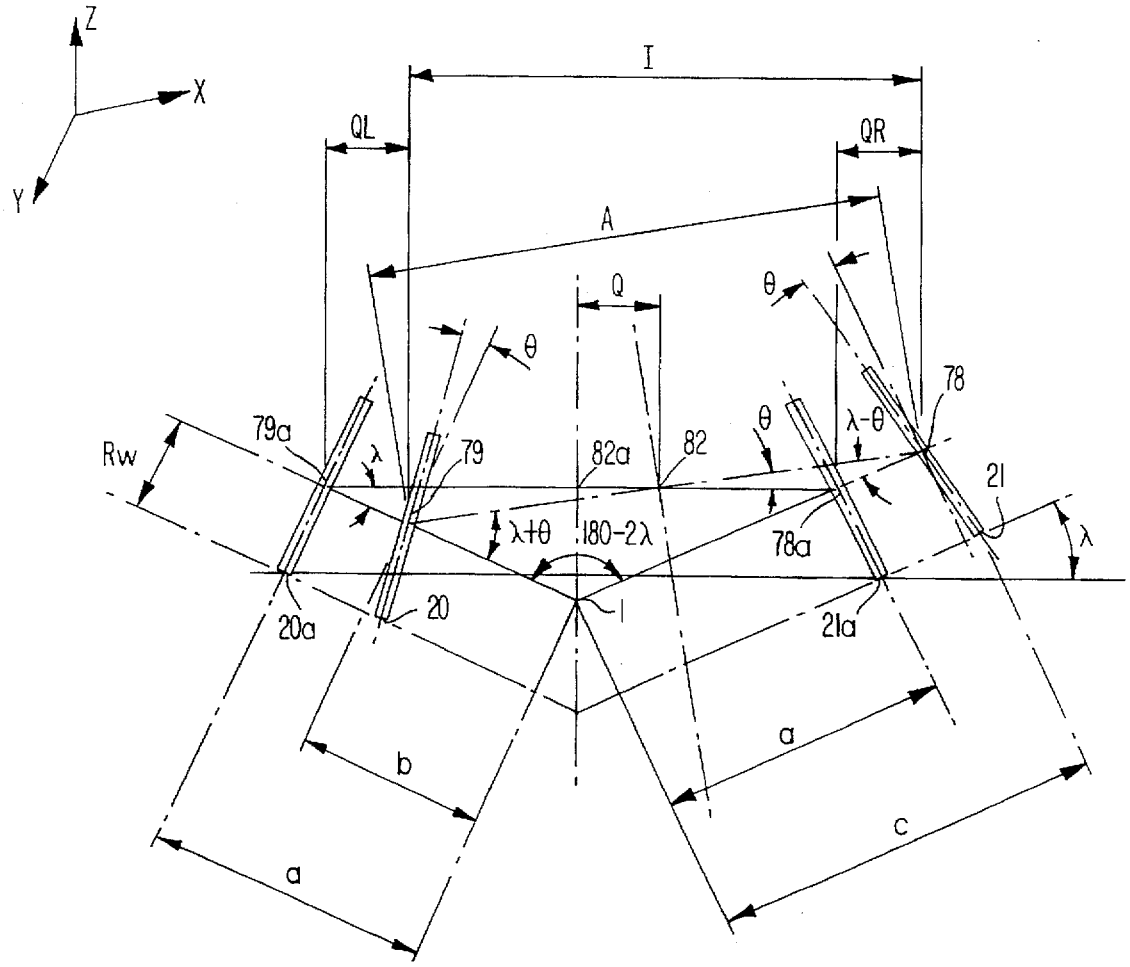
FIG. 21 is a diagrammatic expanded detailed construction of the seventeen axle of FIG. 15.

FIG. 21 is an expanded view of FIG. 15, showing displacement of the front "virtual axle" from its hypothetical neutral position. The "virtual axle" is assumed to be moved laterally by a distance Q (lateral shift of point 82*a* to point 82) and then rotated by angle θ. It is assumed that the ends of the "virtual axle" (points 78, 79) will move along a straight line parallel to the rail surface. This assumption is considered correct for angles θ being typically very small. A lateral shift of both ends 78 and 79 of the "virtual axle" are denoted as QR and QL respectively. The wheel radius Rw is shown as a distance between the wheel rail contact 20*a* and the end of the "virtual axle" 79*a*.

Method for design of the pivot

The following dimensions are given, or may be calculated from given dimensions:

- Wheelbase (B) distance between points 81 and 82*b* (FIG. 19)
- Rail dihedral angle (λ) (FIGS. 15 & 21)
- Wheel radius (Rw) (FIG. 21)
- Wheel/rail contact centers (T) distance 85 (FIGS. 15 & 16)
- Radius of curvature, of the center of the track (R) distance 81, 84 (FIG. 16)

The dimensions to be calculated are:

- pivot inclination (α) (FIG. 17)
- leading arm length E (FIG. 18)
- The pivot position which is defined by the distance of point 83 in front of rear axle (C) and the distance of point 83 below rear axle (D) or alternatively by intersection of the pivot line with the rail line at point 87 (distance N from the front contact point 20*b*)(FIG. 19)
- Front axle offset distance (Q) (FIGS. 16 & 21)
- Pivot rotation angle (β) (FIG. 18)

Calculation Method

Defining Steering Gain (G)

The ratio of the amount of steering resulting from a twist imparted to the bogie from the rails is designated gain (G). This is defined as:

gain (G)=steering angle (γ)
angle twist angle (θ)

Depending on the application, G may be of the order of between 1 and 8. Appropriate design value of gain should be selected for particular application.

Calculate Steering angle (γ)
approx $\gamma = 2 \arcsin (B/2R)$ 1
this is assumed to be exact, ie $\gamma = 2 \arcsin (B/2R)$
Calculate twist angle (0)
from gain $0 = \gamma/G$ 2
Calculated length of "virtual axle" (A) Ref. FIG. 21
$A = T - 2Rw \sin \lambda$ 3
Calculate Offset Distance Q Ref FIG. 21

Using sine rule $\frac{b}{\sin(\lambda - 0)} = \frac{A}{\sin(180 - 2\lambda)}$ $$b = A\frac{\sin(\lambda - 0)}{(180 - 2\lambda)} = \frac{A \sin(\lambda - 0)}{\sin 2\lambda} \quad 4a$$

-continued

Using sine rule $\frac{a}{\sin \lambda} = \frac{A}{\sin(180 - 2\lambda)}$ $$a = A\frac{\sin \lambda}{\sin(180 - 2\lambda)} = \frac{A \sin \lambda}{\sin 2\lambda} \quad 4b$$

Using sine rule $\frac{c}{\sin(\lambda + 0)} = \frac{A}{\sin(180 - 2\lambda)}$ $$c = \frac{A \sin(\lambda + 0)}{\sin(180 - 2\lambda)} = \frac{A \sin(\lambda + 0)}{\sin 2\lambda} \quad 4c$$

left wheel offset $$Q1 = (a - b)\cos \lambda = \frac{A \cos \lambda (\sin \lambda - \sin(\lambda - 0))}{\sin 2\lambda} \quad 4d$$

Right wheel offset $$QR = (c - a)\cos \lambda = \frac{A \cos \lambda (\sin(\lambda + 0) - \sin \lambda)}{\sin 2\lambda} \quad 4e$$

Central offset $$Q = 1/2\,(Q1 + QR) = \frac{A \cos \lambda (\sin(\lambda + 0) - \sin(\lambda - 0))}{2 \sin 2\lambda}$$

$$Q = \frac{A \cos^2 \lambda \sin 0}{\sin 2\lambda} \quad 5$$

NOTE:
For typical small angles 0, variations between Q, Q1 and QR would not exceed 0.5%.
Calculate i Refer FIG. 16
From triangle 84, 81, 88
$R = (R + Q + i/\cos \gamma) \cos \gamma$
$i = R - (R + Q) \cos \gamma$ 6
Calculate pivot inclination α Refer FIG. 17
$H = A \sin 0$ 7a
$I = A \cos 0$ 7b
$J = I \sin \gamma$ 7c
$\alpha = \arctan (H/J) = \arctan (\tan 0/\tan \gamma)$ 8

NOTE:
Practical approximation of $\alpha = \arctan (1/G)$ may be used if non exact solution is required.
Calculate pivot rotation angle β Refer FIG. 18
$M = H/\sin \alpha = A \sin 0/\sin \alpha$ 9
$\beta = \arcsin (M/A) = \arcsin (\sin 0/\sin \alpha)$ 10
Calculate leading arm E Refer FIG. 18
$E = i/\sin \beta$ 11
Calculate pivot postion D & C Refer FIG. 19
$D = E \sin \alpha$ 12
$C = B - (E \cos \alpha)$ 13
Calculate pivot intersection line with the rail level N Refer FIG. 19
$N = B - C - (Rw \cos \lambda - D) \tan \alpha$ 14
$N = E \cos \alpha - (Rw \cos \lambda - E \sin \alpha) \tan \alpha$ 15

The embodiments of the invention as described above are given by way of example only as constituting preferred forms of the invention defined broadly above in its various aspects.

It will be appreciated by persons skilled in the art that numerous variations and/or modifications may be made to the invention as shown in the specific embodiment without departing from the spirit or scope of the broadly described invention. The present embodiments are therefore to be considered in all respects as illustrative and not restrictive.

I claim:

1. A self steering railway bogie configured to run on a railway track having two opposed rails defining a track centerline therebetween, the bogie having a forward end and a rearward end and comprising:

a pair of axle sets including a forward axle set and a rearward axle set disposed at the forward end and at the rearward end of the bogie, respectively, each axle set having a pair of independently rotating wheels defining wheel axes, each wheel being disposed at a respective side of a corresponding axle set and further having a rail-engaging profile such that a wheel of each axle set moving away from the track centerline rises and a wheel of each axle set moving toward the track centerline falls, the axle sets being configured such that, when the bogie enters and traverses a curved section of track defining a center of curvature, the wheels of the forward axle set move away from the center of curvature and the wheels of the rearward axle set move toward the center of curvature whereby the forward axle set and the rearward axle set become inclined at different inclination angles with respect to a horizontal plane as a function of a curvature of the track; and a mechanism arranged and constructed for steering the bogie in response to the inclination angles of the axle sets such that the wheel axes converge on the center of curvature of the curved section of track.

2. The railway bogie according to claim 1, wherein each axle set comprises two axles, each axle defining an axle axis and being connected to one of the wheels of the corresponding axle set, each axle axis being inclined downwardly toward the track centerline.

3. The railway bogie according to claim 2, wherein:

each axle is individually pivotable about a steering pivot defining a steering axis;

the mechanism for steering includes means for steering each wheel by steering a corresponding axle of the wheel about its steering axis such that the wheel axes converge on the center of curvature of the curved section of track.

4. The railway bogie according to claim 1, wherein the rail-engaging profile of each wheel is partially cylindrical.

5. The railway bogie according to claim 1, wherein the axle sets are configured such that lines passing through contact faces between the wheels and the rails and normal thereto intersect at a height approximately corresponding to a height of a center of gravity of the bogie together with any carriage supported thereon.

6. The railway bogie according to claim 1, wherein the axle sets are configured such that lines passing through contact faces between the wheels and the rails and normal thereto intersect at a height substantially higher then a center of gravity of the bogie together with any carriage supported thereon.

7. The railway bogie according to claim 1, wherein:

the axle sets are disposed such that they together define a vertical longitudinal midplane passing through a mid-section of each axle set; and at least one of the axle sets is pivotable about a midplane axis disposed within the vertical longitudinal midplane and inclined relative to a horizontal direction.

8. The railway bogie according to claim 7, wherein the at least one of the axle sets comprises the pair of axle sets, the bogie further comprising means connected to each axle set for fixing one of the axle sets against pivoting about its midplane axis while another one of the axle sets is free to pivot about its midplane axis.

9. The railway bogie according to claim 1, wherein each axle set comprises two axles, each axle being connected to one of the wheels of the corresponding axle set, each axle further being individually pivotable about a steering pivot defining a steering axis, steering pivots of axles of each axle set being disposed at respective opposite ends of the corresponding axle set, the bogie further comprising a pair of longitudinally extending side frame members, each side frame member interconnecting the steering pivots on each lateral side of the bogie, the side frame members further being rotatable relative to one another about a common axis transverse to a longitudinal axis of the bogie in response to a relative rise of two diagonally opposite ones of the wheels and a relative corresponding fall of two other diagonally opposite ones of the wheels, wherein the mechanism for steering includes: a steering transfer box responsive to a rotation of the side frame members relative to one another; and linkage means connected to the steering transfer box for steering at least one pair of axles.

10. A self steering railway bogie configured to run on a railway track having two opposed rails, the bogie having a pair of axle sets one at each end, each axle set having a pair of wheels at opposite sides thereof, each wheel being independently rotatable on an axle, the wheels of at least one axle set having contours on the periphery thereof such that, on being displaced laterally with respect to the other axle set and relative to the center line of the track, one wheel will rise and the other will fall with respect to the wheels of said second axle set whereby said one axle set becomes tilted with respect to said second axle set and means responsive to said tilt to steer one or both axle sets, wherein the axle set of each wheel has an axis which is inclined downwardly toward the center of the track, the wheels having the contours on their periphery where they contact said track, the contours being downwardly inclined toward the center of the track, wherein said means responsive to said tilt of one of said axle sets with respect to the other axle set is connected by a linkage to the axles and is constructed and arranged so as to steer each said axle set so that each wheel of the set tends to align with the center line of the respective rail beneath it.

11. A self steering railway bogie as claimed in claim 10, in which said contours are cylindrical.

12. A self steering railway bogie configured to run on a railway track having two opposed rails, the bogie having a pair of axle sets one at each end, each axle set having a pair of wheels at opposite sides thereof, each wheel being independently rotatable on an axle, the wheels of at least one axle set having contours on the periphery thereof such that, on being displaced laterally with respect to the other axle set and relative to the center line of the track, one wheel will rise and the other will fall with respect to the wheels of said second axle set whereby said one axle set becomes tilted with respect to the second axle set, and means responsive to said tilt to steer one or both axle sets; wherein the axle of each wheel of at least one of said axle sets has an axis which is inclined downwardly toward the center of the track, and wherein the wheels of said at least one of said axle sets have the contours on their periphery where they contact said track, the contours being downwardly inclined toward the center of the track, wherein said means responsive to said tilt of one of said axle sets with respect to the other axle set is connected by a linkage to the axle sets, and is constructed and arranged so as to steer each said axle set so that each wheel of the set tends to align with the center line of the respective rail beneath it.

13. A self steering railway bogie as claimed in claim 12, wherein lines passing through contact faces between the wheels and the rails and normal thereto intersect at a height approximating the height of the center of gravity of the bogie and any carriage supported thereby.

14. A self steering railway bogie as claimed in claim 12, wherein lines passing through contact faces between the wheels and the rails and normal thereto intersect at a height substantially higher than the center of gravity of the bogie and any carriage supported thereby.

15. A self steering railway bogie as claimed in claim 12, wherein at least one of said axle sets is pivotal about an axis located within a vertical longitudinal midplane of the axle sets and inclined to the horizontal.

16. A self steering railway bogie as claimed in claim 15, wherein both axle sets are pivotable about axes located within the vertical longitudinal midplane of the axle sets and inclined to the horizontal, means being provided to fix one of the axle sets against rotation about its axis while another one of the axle sets is free to pivot.

* * * * *